US006099589A

United States Patent [19]

Sowle et al.

[11] Patent Number: 6,099,589

[45] **Date of Patent: *Aug. 8, 2000**

[54] PRESOAK DETERGENT WITH OPTICAL BRIGHTENER

[75] Inventors: Eddie D. Sowle, Jamestown; Carleton J. Parker, III, Greensboro, both of N.C.

[73] Assignee: Kay Chemical Company, Greensboro, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 09/000,695

[22] Filed: Dec. 30, 1997

[51] Int. Cl.[7] ..... D06B 1/00; D06L 1/16; C11D 3/42

[52] U.S. Cl. ..... 8/137; 510/284; 510/405; 510/301; 510/325; 510/324; 510/513; 510/535; 510/537; 510/421; 510/424; 510/394; 134/26; 134/29; 134/42

[58] Field of Search ..... 8/137; 510/284, 510/405, 301, 325, 324, 513, 535, 537, 421, 424, 394; 134/26, 29, 42

[56] References Cited

U.S. PATENT DOCUMENTS

| | | | |
|---|---|---|---|
| 3,413,331 | 11/1968 | Beiser et al. . | |
| 3,468,805 | 9/1969 | Grifo et al. . | |
| 3,748,093 | 7/1973 | Gangwisch et al. | 510/283 |
| 3,755,407 | 8/1973 | Wilkes . | |
| 3,775,349 | 11/1973 | Tuvell et al. . | |
| 3,998,750 | 12/1976 | Payne et al. | 510/325 |
| 4,079,020 | 3/1978 | Mills et al. . | |
| 4,092,272 | 5/1978 | Nishimura et al. . | |
| 4,133,779 | 1/1979 | Hellyer et al. . | |
| 4,140,641 | 2/1979 | Ramachandran . | |
| 4,146,496 | 3/1979 | Gray . | |
| 4,233,167 | 11/1980 | Sramek | 510/325 |
| 4,316,824 | 2/1982 | Pancheri . | |
| 4,690,305 | 9/1987 | Copeland . | |
| 4,790,856 | 12/1988 | Wixon . | |
| 5,152,921 | 10/1992 | Weber et al. | 510/325 |
| 5,279,772 | 1/1994 | Eckhardt et al. | 510/325 |
| 5,332,528 | 7/1994 | Pan et al. . | |
| 5,454,982 | 10/1995 | Murch et al. . | |
| 5,483,339 | 1/1996 | Van Aken et al. . | |

OTHER PUBLICATIONS

Derwent abstract 09400A/05 for JP 52–152,405, Dec. 1977.

*Primary Examiner*—Alan Diamond
*Attorney, Agent, or Firm*—Merchant & Gould, P.C.

[57] ABSTRACT

In fabric laundry procedures, commercial and household laundry detergent compositions commonly contain an optical brightener composition. Brighteners adjust the optical properties of the fabric in such a way that the fabric appears to be white even after repeated washings. Often white fabrics can yellow during use. Fluorescent optical brighteners having an optical blue aspect, mask the yellowing of the fabric. Common laundry detergents fail to have sufficient brightening capacity to brighten heavily soiled white cotton items used in household, commercial, institutional or fast-food food surface. A process for improving the whiteness of soiled white cotton, preferably terry cloth, items involves contacting the soiled white fabric item with a presoak containing an effective proportion of a fluorescent optical brightener composition, removing the item from the presoak and separating the presoak composition from the fabric item producing an extracted item. The extracted item is then laundered in a laundry detergent composition containing a brightener. The resulting white fabric items have substantially improved whiteness when compared to similarly soiled items laundered in conventional processes.

10 Claims, No Drawings

PRESOAK DETERGENT WITH OPTICAL BRIGHTENER

FIELD OF THE INVENTION

The invention relates to laundry processes for soiled white cotton fabrics, preferably cotton fabric towels and cotton terry cloth towels. The invention also relates to multistep laundry processes involving contacting white cotton fabric items with at least an aqueous prestain or presoak and a laundry composition to obtain bright, white fabric.

BACKGROUND OF THE INVENTION

After multiple uses and laundering processes, white cotton fabric items can often obtain a yellowed appearance or cast. The yellow is produced by the absorption by the used fabric of short wavelength light typically in the blue to violet to ultraviolet frequencies commonly about 400–550 nanometers (nm). The absorption of these bluish wavelengths from ambient light imparts a visible yellow tint. In order to restore the appearance of the fabric to a bright white appearance, optical brighteners are often used. Such brighteners absorb in the typically invisible, ultraviolet wavelengths of about 275 to 400 nm and then re-emit at wavelengths typically from about 400 to about 525 nm. The peak of the common emission curve of energy from optical brighteners is well in the blue range of visible spectrum and is typically from 425–450 nm. The emitted blue light masks the yellowish appearance in a complimentary fashion and results in a bright white appearance.

Optical brighteners have been common in laundry detergents. Ramachandran, U.S. Pat. No. 4,140,641 discloses a concentrated liquid detergent for fabric containing a variety of ingredients including detergent components, softener components and an optical brightener. Wicksen, U.S. Pat. No. 4,790,856 discloses a softener antistatic agent containing softening and antistatic ingredients in combination with a brightener.

Brighteners are also disclosed in *Kirk-Othmer Encyclopedia of Chemical Technology*, John Wiley & Sons (1985) at pp. 184–185.

In restaurants, fast food and other such environments, having large quantities of soil resulting in fabric that resists brightening, simple laundering of fabric items in well formulated brightened laundry detergents can result in a less than bright white finish. One particular longfelt need is in the laundering of white cotton fabric towels or white cotton terry cloth towels in institutional or commercial kitchen environments. Such towels come in contact with substantial quantities of difficult to clean fatty soils which can have a variety of interactions with inorganic soils, oxidizing atmospheres, and other conditions resulting in hard to clean and yellowed fabrics. While the use of brightening agents is known and brightening agents have been formulated in both laundry detergents and softening agents, substantial need exists for improving laundry processes for cleaning soiled such white cotton fabrics. Many cotton fabrics such as white terry cloth towels become so soiled or stained that a simple laundry process cannot remove staining and/or obtain the desired bright white appearance.

Presoak compositions are also known for use in laundry processes in which the soiled material is contacted with a prespot or prestain composition or soaked in a presoak composition for the purpose of bringing soil removing compositions in intimate contact with the soil or stain. Presoak and prestain materials are used in both household and commercial or institutional laundry processes to remove stubborn soil such as grass stains, blood stains, food soils, soil from shop rags, kitchen cleaning operations, etc. Such presoaks primarily rely on the detergent activity of anionic and nonionic surfactant materials to initiate a soil/surfactant interaction that begins the removal process of soil from fabric. When the prespotted or presoaked material is then laundered, the pretreated soil becomes more easily removable. We have found that even through the use of conventional prespotting and presoaking compositions that when cleaning white cotton fabrics contaminated with certain soils, the fabrics do not achieve the desired bright white appearance.

BRIEF DISCUSSION OF THE INVENTION

We have found that laundry processes involving cleaning soiled white cotton fabric such as cotton towels or white terry-cloth towels, can be substantially improved if the fabric is initially contacted with an aqueous liquid presoak composition comprising a substantial proportion of optical brightener for a sufficient period of time. After the brightened presoak step, the fabric is removed from the presoak and the presoak composition is removed or expressed from the fabric. The fabric is then introduced into a conventional laundry step and is washed with a laundry composition also comprising an optical brightener. Surprisingly, the brightener composition in the presoak carries over into the laundry step and provides brightening in the finished fabric items. A second aspect of the invention is a formulation for the brightened presoak composition containing a unique combination of ingredients resulting in a highly effective composition that results in a bright white product after laundry processing. For the purpose of this patent application, the term "optical brightener" includes materials referred to as fluorescent whitening agents or fluorescent brightening agents. Such materials act to optically compensate for the yellow cast of substrates resulting from use and age. The optical brightener emits short wavelength light in the violet to blue wavelengths comprising 400 to 490 nm and absorb in the typically ultraviolet wavelengths of about 250 to 400 nm. Preferred optical brighteners are colorless on the fabric. The term "fabric" typically connotes both woven and nonwoven fabrics. The improved process of the invention involves contacting soiled fabric with an aqueous brightened presoak composition followed by a conventional brightened aqueous detergent cleaning step.

DETAILED DISCUSSION OF THE INVENTION

Process

The process of the invention resulting in substantially improved brightness in cotton towels or cotton terry cloth towels involves a multistep, preferably a two step, laundry method in which an effective amount of brightener is present in each operative step. We have found that an effective amount, typically from about 0.001 to about 0.1 weight percent (wt %) of optical brightener in a presoak step followed in a laundry process by a subsequent laundering step in which both the presoak and the laundering step and other steps that come before the presoak step, after the laundry step or between such steps containing brightener improve the bright white appearance of the fabric items. Preferably, we have found that the presoak or laundry compositions can contain about 0.02 to about 0.05 wt % of the optical brightener.

In conducting the invention, at a minimum, the soiled towels are placed in a suitable container containing a sufficient volume of the presoak composition. By sufficient volume, we mean that the volume of presoak is sufficient to wet every portion of the treated fabric and have sufficient presoak to at least substantially submerge the towel in the presoak composition. The towel should be immersed in the presoak for sufficient amount of time such that the comparatively insoluble brightener contacts, is absorbed or adsorbed onto the surface of the fiber reducing the yellow cast. Such an amount of time is typically greater than one minute and typically less than five hours. Commonly, in many operating environments, a container containing a volume of the presoak is maintained in the work space and soiled towels are periodically added to the container until the container is full. At that time the container is then taken to a laundry station where the towels are removed from the container, the presoak is removed from the fabric and the fabric is then laundered. Preferably, the presoak is removed from the fabric items. The presoak can be removed by simply draining the material in a sink or other container. Elowever, the presoak can be mechanically expressed from the towel by compressing, wringing, pressing or exposing the fabric to some application of pressure to drive the liquid from the fabric item. The fabric items can be put aside or can be directly placed in the laundry machine with a brightened laundry detergent. After the laundry presoak, the fabric items can be laundered conventionally except that the laundry detergent must contain an effective amount of an optical brightener material. Conventional brightened laundry products can be used. Similar concentrations of the brightener can be used in the laundry detergent as used in the presoak material. Once the laundering process is over, the cleaned, rinsed and spun fabric can be bleached, used damp or conventionally dried resulting in an improved towel with a bright white appearance.

Presoak Composition

The presoak comprises a brightener and conventional surfactants, solvents, extenders and other detergent or cleaner components

Brighteners

Optical brightener, also referred to as fluorescent whitening agent or fluorescent brightening agent, provides optical compensation for the yellow cast in fabric substrates. With optical brighteners yellowing is replaced by light emitted from optical brighteners present in the area commensurate in scope with yellow color. The violet to blue light supplied by the optical brighteners combines with other light reflected from the location to provide a substantially complete or enhanced bright white appearance. This additional light is produced by the brightener through fluorescents. Optical brighteners absorb light in the ultraviolet range 275 through 400 nm and emit light in the ultraviolet blue spectrum 400–500 nm.

Fluorescent compounds belonging to the optical brightener family are typically aromatic or aromatic heterocyclic materials often containing a condensed ring system. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.). The choice of optical brighteners for use in detergent compositions will depend upon a number of factors, such as the type of detergent, the nature of other components present in the detergent composition, the temperature of the wash water, the degree of agitation, and the ratio of the material washed to the tub size. The brightener selection is also dependent upon the type of material to be cleaned, e.g., cottons, synthetics, etc. Since most laundry detergent products are used to clean a variety of fabrics, the detergent compositions should contain a mixture of brighteners which are effective for a variety of fabrics. It is of course necessary that the individual components of such a brightener mixture be compatible.

Optical brighteners useful in the present invention are commercially available and will be appreciated by those skilled in the art. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene.

Certain derivatives of bis(triazinyl)aminostilbene which may be useful in the present invention may be prepared from 4,4'-diamine-stilbene-2,2'-disulfonic acid. Examples of such derivatives include, but are not limited to those compounds disclosed at pages 39–42 of the Zahradnik reference which have the general formula I:

I

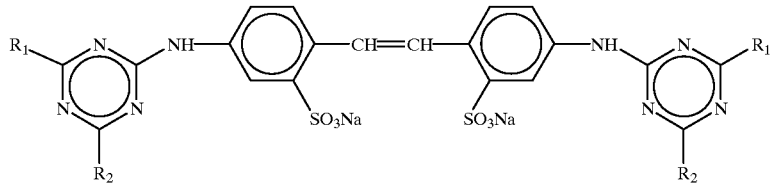

wherein $R^1$ and $R^2$ are each selected from, respectively, C1 and $N(CH_2CH_2OH)_2$; $NH_2$ and $NHCH_2CH_2OH$; $N(CH_3)CH_2CH_2SO_3H$ and $N(CH_2CH_2OH)_2$; $NH_2$ and $NHC_6H_5$; $NHCH_2CH_2OH$ and $NHC_6H_5$; $N(CH_2CH_2OH)_2$ and $NHC_6H_5$; $N(CH_2CH_2OH)_2$ and $NHC_6H_4SO_3H$ (1,3); $N(CH_2CH_2OH)_2$ and $NHC_6H_3(SO_3H)_2$ (1,2,4); $N(CH_3)CH_2CH_2SO_3H$ and $NHC_6H_4SO_3H$ (1,3); $NHC_6H_5$ and $NHC_6H_5$; $NHC_6H_4SO_3H$ (1,4) and $NHC_6H_4SO_3H$ (1,4); $NHC_6H_5$ and morpholino; $NHC_6H_3(SO_3H)_2$ (1,2,4) and morpholino; $NHCH_2CH_2SO_3H$ and $NHC_6H_3(SO_3H)_2$ (1,2,4); $OCH_3$ and $N(CH_2CH_2OH)_2$; $OCH_3$ and $N(CH_3)CH_2CH_2SO_3H$; OH and $NHC_6H_5$; $OCH_3$ and $NHC_6H_5$; $NHC_6H_5$ and $NHC_6H_4SO_3H$ (1,3); and $OCH_3$ and $NHCH_3$; $-R^1$ and $R^2$ may also be individually selected from chloro, bromo, hydroxy, $C_1$–$C_4$ alkoxy, phenoxy, methyl-phenoxy, hydroxyoxaalkylamino, piperidino, pyrrolidino, analino, substituted anilino, amino, aliphatic amine, heterocyclic amine, and thio groups.

Examples of other stilbene derivatives which may be useful as optical brighteners in the present invention can be found under the heading "Brighteners, Optical", in *Kirk-Othmer Encyclopedia of Chemical Technology*, Volume 3, pp. 737–750 (1962), the disclosure of which is incorporated herein by reference.

Examples of pyrazoline derivatives which may be useful in the present invention include, but are not necessarily limited to, those disclosed on pages 59–62 of the Zahradnik reference.

Coumarin derivatives which may be useful in the present invention include, but are not necessarily limited to, derivatives substituted in the 3-position, in the 7-position, and in both the 3- and 7-positions. Examples of coumarin derivatives substituted in the 3-position include, but are not necessarily limited to, those disclosed on pages 63–64 of the Zaliradnik reference. Examples of coumarin derivatives substituted in the 7-position include, but are not necessarily limited to, those disclosed on pages 64–66 of the Zahradnik reference. Examples of coumarin derivatives substituted in both the 3- and 7-positions include, but are not necessarily limited to, those disclosed on pages 66–71 of the Zalradnik reference. Other examples of coumarin derivatives which may be useful in the present invention are disclosed at pages 744–745 of the Kirk-Othmer reference.

Carboxylic acid derivatives which may be useful as optical brighteners in the present invention include, but are not necessarily limited to, fumaric acid derivatives; benzoic acid derivatives; p-phenylene-bis-acrylic acid derivatives; naphthalenedicarboxylic acid derivatives; heterocyclic acid derivatives; and cinnamic acid derivatives.

Examples of fumaric acid derivatives which may be useful in the present invention include, but are not necessarily limited to, those disclosed at pages 72–74 of the Zahradnik reference. Examples of benzoic acid derivatives which may be useful in the present invention include, but are not necessarily limited to, those disclosed on pages 75–77 of the Zahradnik reference. Examples of ρ-phenylene-bis-acrylic acid derivatives, naphthalenedi-carboxylic acid derivatives, and heterocyclic acid derivatives which may be useful in the present invention include, but are not necessarily limited to, those disclosed on pages 84–91 of the Zahradnik reference.

Cinnamic acid derivatives which may be useful as optical brighteners in the present invention can be further subclassified into groups which include, but are not necessarily limited to, styryltriazoles, and styrylpolyphenyls, as disclosed on page 77 of the Zahradnik reference. Styrylazoles can be further subclassified into styrylbenzoxazoles, styrylimidazoles and styrylthiazoles, as disclosed on page 78 of the Zahradnik reference. It will be understood that these three identified subclasses may not necessarily reflect an exhaustive list of the subgroups into which styrylazoles may be subclassified.

Examples of cinnamic acid derivatives which may be useful in the present invention include, but are not necessarily limited to, those disclosed on pages 77–78 of the Zahradnik reference.

Examples of styrylbenzoxazole derivatives, 2-styrylbenzimidazole derivatives, styrylbenzofuran derivatives, styryloxadiazole derivatives, and styrylpolyphenyl derivatives which may be useful in the present invention include, but are not necessarily limited to, those disclosed on pages 78–83 of the Zahradnik reference.

Methinccyanine derivatives which may be useful as optical brighteners in the present invention include, but are not necessarily limited to, those disclosed at pages 91–93 of the Zahradnik reference. Examples of these types of brighteners include oxamethinecyanines and thiamethinecyanines.

Another class of brighteners which may be useful in the present invention are the derivatives of dibenzothiophene-5,5-dioxide disclosed on pages 741–749 of the Kirk-Othmer reference. Examples of such brighteners include, but are not necessarily limited to, 3,7-diaminodibenzothiophene-2,8-disulfonic acid 5,5 dioxide.

Still another class of brighteners which may be useful in the present invention include azoles, which are derivatives of 5-membered ring heterocycles. These can be further subcategorized into monoazoles and bisazoles. Examples of monoazoles are disclosed at pages 741–743 of the Kirk-Othmer reference. Examples of bisazoles which may be useful in the present invention are disclosed at pages 743–744 of the Kirk-Othmer reference.

An additional class of brighteners which may be useful in the present invention are the derivatives of 6-membered-ring hetero-cycles disclosed on page 745 of the Kirk-Othmer reference. Examples of such compounds include brighteners derived from pyrazine and brighteners derived from 4-aminonaphthalamide.

In addition to the brighteners already described, miscellaneous agents may also be useful as brighteners. Examples of some of these miscellaneous agents are disclosed at pages 93–95 of the Zahradnik reference, and include 1-hydroxy-3,6,8-pyrenerrisulfonic acid; 2,4-dimethoxy-1,3,5-triazin-6-yl-pyrene; 4,5-di-phenylimidazolonedisulfonic acid; and derivatives of pyrazoline-quinoline.

Other examples of optical brighteners which may be useful in the present invention are those disclosed in U.S. Pat. No. 4,790,856, issued to Wixon on Dec. 13, 1988, the disclosure of which is incorporated herein by reference. These brighteners include the following Phorwhites from Verona: BHC, BKL, BUP, BBH solution, BRN solution, DCR liquid, DCBVF, EV liquid, DBS liquid and ANR. other brighteners disclosed in this reference include, Tinopal UNPA. Tinopal CBS and Tinopal 5BM, available from Ciba-Geigy, located in Switzerland; Arctic White CC and Artic White CWD, available from tlilton-Davis, located in Italy; the 2-(4-styryl-phenyl)-2H-naphthol-[1,2-d]triazoles; 4,4'-bis(1,2,3-triazol-2-yl)-stilbenes; 4,4'-bis-(styryl)-bisphenyls; and the y-aminocoumarins. Specific examples of these brighteners include 4-methyl-7-diethyl-amino coumarin; 1,2-bis(-benzimidazol-2-yl)ethylene; 1,3-diphenylphrazolines; 2,5-bis(benzoxazol-2-yl)thiophene; 2-styryl-naphth-[1,2-d]oxazole; and 2-(stilbene-4-yl)2H-naphth-[1,2-d]triazole.

Other optical brighteners which may be useful in the present invention include those disclosed in U.S. Pat. No. 3,646,015, issued Feb. 29, 1972 to Hamilton, the disclosure of which is incorporated herein by reference and those disclosed in U.S. Pat. No. 4,483,780, issued Nov. 20, 1984 to Llenado, the disclosure of which is incorporated herein by reference.

Other anionic optical brighteners include:

wherein A is:

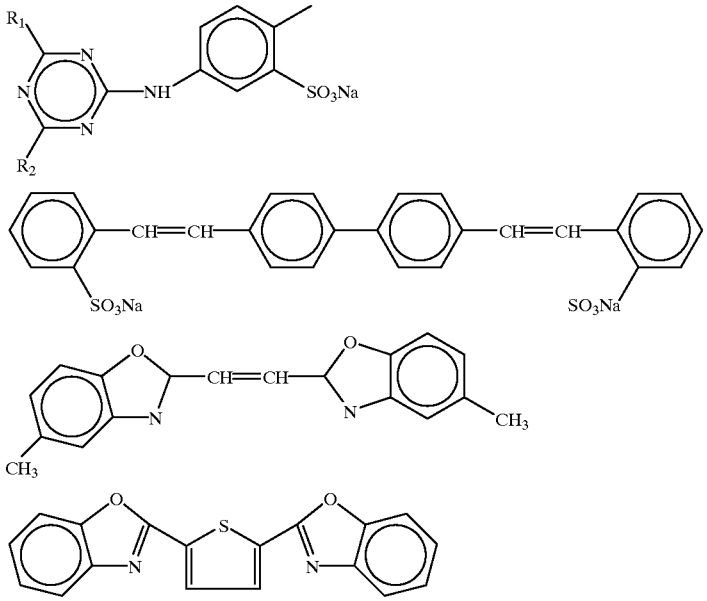

and others and mixtures thereof, wherein $R^1$ is $—NHC_6H_5$ and $R^2$ is selected from groups of $—N(CH_2CH_2OH)_2$; $—N(CH_3)CH_2CH_2OH_3$; $—NHC_6H_5$ and a morphol group.

Surfactants

Anionic Surfactants

Anionic surfactants useful for detersive purposes can also be included in the compositions hereof. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates. $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, acyl laurates, fatty acid amides of methyl tauride, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates; sulfates of alkylpolysaccharides such as the sulfates of alkylpolyglucosode (the nonionic nonsulfated compounds being described below), branched primary alkyl, sulfates, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. One type of anionic surfactant which can be utilized encompasses alkyl ester sulfonates. Alkyl ester sulfonate surfactants hereof include linear esters of $C_8$–$C_{20}$ carboxylic acids (i.e., fatty acids) which are sulfonated with gaseous $SO_3$ according to "The Journal of the American Oil Chemists Society." 52 (1975), pp. 323–329. Suitable starting materials would include natural fatty substances as derived from tallow, palm oil, etc. The preferred alkyl ester sulfonate surfactant, especially for laundry applications, comprise alkyl ester sulfonate surfactants:

$$M^{+-}50_3—(R^{-3})CH—C—OR^4$$

wherein $R^3$ is a $C_8$–$C_{20}$ hydrocarbyl, preferably an alkyl, or combination thereof. $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{-20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations such as tetramethylammonium and dimethyl piperdinium cations and quaternary ammonium cations derived from alkylamines such as ethylamine, diethylamine, triethylamine, and mixtures thereof, and the like). Alkyl alkoxylated sulfate surfactants hereof are water soluble salts or acids of the formula $RO(A)_mSO_3—M^+$ wherein R is an unsubstituted $C_{10}$–$C_{24}$ alkyl or hydroxy alkyl group having a $C_{10}$–$C_{24}$ alkyl component, preferably $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.). ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium cations and quaternary ammonium cations such as tetramethyl-ammonium and dimethyl piperdinium cations and those derived from alkylamines such as ethylamine, diethylamine, triethyl-amine, mixtures thereof, and the like.

Nonionic Detergent Surfactants

Conventional, nonionic detersive surfactants for purposes of this invention include:

1. the polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal™ CO-630, marketed by the GAF Corporation; and Triton™ X-45, X-114, X-100, and X-102, all marketed by the Rohm & Haas Company.

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 10 moles of ethylene oxide per mole of alcohol. Examples of commercially available nonionic surfactants of this type include Tergitol™ 15.5.9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.5 moles of ethylene oxide), Neodol™ 45.7 (the condensation product of $C_{14}$–$C_{15}$ linear alcohol with 7 moles of ethylene oxide), Neodol™ 45.4 (the condensation product of $C_{14}$–$C_{15}$ linear alcohol with 4 moles of ethylene oxide), marketed by Shell Chemical Company, and Kyro™ EOB (the condensation product of $C_{13}$–$C_{15}$ alcohol with 9 moles ethylene oxide), marketed by The Procter & Gamble Company.

3. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic™ surfactants, marketed by BASF.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

5. Semi-polar nonionic surfactants are a special category of nonionic surfactants which include water soluble amine oxides containing one alkyl moiety of from about 10 to about 18 carbon atoms and 2 moieties selected from the group consisting of alkyl groups and hydroxyalkyl groups containing from about 1 to about 3 carbon atoms; water soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water soluble sulfoxides containing one alkyl moiety of from about 10 to about 18 carbon atoms and a moiety selected from the group consisting of alkyl and hydroxyalkyl moieties of from about 1 to about 3 carbon atoms. Amine oxide surfactants in particular include $C_{10}$–$C_{18}$ alkyl dimethyl amine oxides and $C_8$–$C_{12}$ alkoxy ethyl dihydroxy ethyl amine oxides.

6. Fatty acid amide surfactants of the formula:

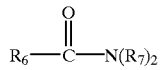

wherein $R_6$ is an alkyl, typically a fatty alkyl, group and $R_7$ is selected $C_{1-4}$ hydroxy alkyl, and $—(C_2H_4O)_xH$ wherein x is about 1 to 3.

Cationic Surfactants

Cationic detersive surfactants can also be included in detergent compositions of the present invention. Cationic surfactants include the ammonium surfactants such as alkyldimethylammonium halogenides, and those surfactants having the formula:

$$[R^2(OR^3)_y][R^4(OR^3)_x]_3R^3N^+X^-$$

wherein $R^2$ is an alkyl or alkyl benzyl group having from about 8 to about 18 carbon atoms in the alkyl chain, each $R^3$ is selected from the group consisting of $—CH_3CH_2—$, $—CH_2CH(CH_3)—$, $—CHCH(CH_2OH)—$, $—CH_2CH_2CH_2—$, and mixtures thereof; each $R^4$ is selected from the group consisting of a $C_1$–$C_4$ alkyl, $C_1$–$C_4$ hydroxylalkyl, benzyl ring joint structures of two $R^4$ groups, $—CH_2CHOH—$, $—CHOHCOR^6CHOHCH_2OH$ wherein $R^6$ is any hexose or hexose polymer having a molecular weight less than about 1000, and hydrogen when y is not O; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Polyhydroxy Fatty Acid Amide

The polyhydroxy fatty acid amide surfactant component of the present invention comprises compounds of the structural formula:

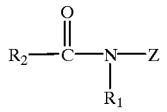

wherein $R_1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R_2$ is a $C_3$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an akoxylated derivative (preferably ethoxylated or propoxylated) thereof, Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}$, $—CH_2OH$, $—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R_1$ can be, for example, N-methyl, N-ethyl, N-propyl, N-isopropyl, N-butyl, N-2-hydroxy ethyl, or N-2-hydroxy propyl.

$R_2—CO—N<$ can be, for example, cocamide, stearamide, oleamide, lauramide, myristamide, capricamide, palmitamide, tallowamide, etc.

Z can be 1-deoxyglucityl, 2-deoxyfrutityl, 1-deoxymaltityl, 1-deoxylactityl, 1-deoxygalactityl, 1-deoxymannitryl, 1-deoxymaltotriotityl, etc.

A useful polyhydroxy fatty acid amide has the general formula:

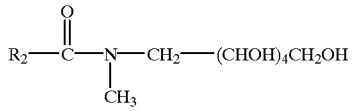

wherein $R_2$ is a $C_{11}$–$C_{17}$ straight chain alkyl or alkenyl group.

Also from about 2% to about 20% of preformed linear N-alkyl/N-hydroxyalkyl, N-linear glucosyl fatty acid amide product is added to the reaction mixture, by weight of the reactants, as the phase transfer agent if the fatty ester is a triglyceride. This seeds the reaction, thereby increasing reaction rate. A detailed experimental procedure is provided below in the Experimental. The polyhydroxy "fatty acid" amide materials used herein also offer the advantages to the detergent formulator that they can be prepared wholly or primarily from natural, renewable, nonpetrochemical feedstocks and are degradable.

Other Ingredients

A wide variety of other ingredients useful in detergent compositions can be included in the compositions hereof, including other active ingredients, builders, carriers, processing aids, dyes or pigments, perfumes, solvents for liquid formulations, hydrotropes (as described below), etc. Liquid detergent compositions can contain water and other solvents. Low molecular weight primary or secondary alcohols exemplified by methanol, ethanol, propanol, and isopropanol are suitable. Monohydric alcohols are preferred for solubilizing surfactant, but polyols such as those containing from about 2 to about 6 carbon atoms and from about 2 to about 6 hydroxy groups (e.g., propylene glycol, ethylene glycol, glycerine, and 1,2-propanediol) can also be used.

The presoak compositions hereof will preferably be formulated such that during use in aqueous cleaning operations the wash water will have a pH of between about 6.5 and about 11, preferably between about 7.5 and about 10.5. Liquid product formulations preferably have a (10% dilution) pH between about 7.5 and about 10.0, more preferably between about 7.5 and about 9.0 Techniques for controlling pH at recommended usage levels include the use of buffers, alkali, acids, etc., and are well known to those skilled in the art.

| Ingredients of a typical presoak Formula | Parts by Weight (useful) | Parts by Weight (preferred) |
|---|---|---|
| $H_2O$ | 25–50 | 25–35 |
| Alkaline Base (50% aqueous active) | 0–10 | 1–10 |
| organic base | 0–10 | 1–8 |
| sulfonate | 5–50 | 5–35 |
| hydroxy fatty acid amide | 0–10 | 1–8 |
| nonionic | 0–10 | 1–10 |
| inorganic builder | 1–10 | 1–10 |
| lower alkanol | 0–10 | 1–10 |
| Tinopal CBS-X Brightener distyrylbiphenyl disulfonate disodium salt | about 0.001–1, preferably 0.005–0.5; most preferably 0.005–0.1 | |

The above specification provides the basis for understanding compositions that can be used in formulating the materials used in the process of the invention. The example and data below provide a basis to understand a specific embodiment of the invention and disclose the best mode.

EXAMPLE I

The following table of ingredients were blended in water in the order presented in the table.

| Ingredients | Parts by Weight |
|---|---|
| $H_2O$ | 37.758 |
| NaOH (50% aqueous active) | 4.000 |
| Triethanol amine | 4.000 |
| Dodecyl benzene sulfonate | 24.000 |
| Amine C-DEA (cocoamide diethanol amide) | 6.000 |
| Nonyl phenol 9.5 mole ethoxylate | 1.500 |
| Sodium linear alkyl ether sulfonate (60% aqueous active) | 11.400 |
| $MgSO_4.7H_2O$ | 5.500 |
| Propylene glycol | 2.500 |
| ETOH | 3.000 |
| Preservative (V-250) | 0.020 |
| Perfume SZ4071 | 0.300 |
| Dye, Blue LX10092 | 0.002 |
| Tinopal CBS-X Brightener | 0.020 |

-continued

| Ingredients | Parts by Weight |
|---|---|
| distyrylbiphenyl disulfonate disodium salt | |
| TOTAL | 100.000 |

The product is a manual dishwash detergent.

Working Example I

Procedure:

1. Cut 16 swatches (approximately 1×2 inches) of white cloth that has not been optically brightened.
2. Dampen cloth with water.
3. "Read" cloth with the Miniscan XE colorimeter integrating between 400 and 700 nm.
4. Make use solution of Example I with brightener and without brightener. 1.7 g product/1 liter water.
5. Add 30 ml. french fry/hamburger soil to use solution. This soil consists of a mixture of 60 percent recovered fast food restaurant frying oil and 40 percent recovered fast food restaurant hamburger grease
6. Put cloth into use solution and soil; stir.
7. Let soak for 1 hour.
8. "Re-read" cloth with the Miniscan XE calorimeter.
9. The test was repeated without adding soil also. Four cloth swatches were used with each solution.

Explanation of Testing Procedure:

The test swatches were read using the method ASTM E313 by a Miniscan XE, manufactured by Hunter Associates Laboratory, Inc. of Reseton, Va. The spectral data for the Miniscan XE is given below:

| Spectral Data | |
|---|---|
| Range | 400–700 nm |
| Resolution | 10 nm |
| Bandwidth | 12 nm |
| Wavelength accuracy | 1 nm |

Several aspects of the results must be explained. "WI" indicates whiteness index which increases with increasing brightness, "L" or "L*" indicates the lightness of the sample (100=white, 0=black), "a" or "a*" indicates redness/greeness (red when positive and green when negative), "b" assigns a numerical value to the extent of yellowish/bluish appearance present in a test swatch (yellow when positive and blue when negative). This value increases as the sample becomes more yellowish in appearance. WI, the whiteness index, is calculated as follows.

$$WI=0.01L(L-5.7b)$$

The data is given below:

| Before | After | Before | After |
|---|---|---|---|
| Polar Blue with Brightener | | Polar Blue Without Brightener | |
| RESULTS WITH SOIL | | | |
| L 91.42 | 92.74 | L 90.47 | 93.00 |
| a −.48 | .15 | a −.51 | −.68 |
| b 1.13 | −1.60 | b 1.03 | 1.74 |
| WI 76.97 | 95.94 | WI 75.89 | 76.07 |
| RESULTS WITHOUT SOIL | | | |
| L 93.14 | 91.84 | L 93.27 | 93.33 |
| a −.46 | .28 | a −.47 | −.50 |
| b 1.15 | −2.44 | b 1.02 | .86 |
| WI 79.86 | 99.33 | WI 80.90 | 82.05 |

Several conclusions can be drawn from the above data. In each case, the whiteness index increases substantially with the use of brightener. It is also apparent that the presence of soil has no effect on the effectiveness of the brightener.

The above specification, example and data provide a clear basis for understanding the operation of the compositions and methods of the invention. While the invention can be embodied in a variety of specific examples and processes, the invention resides in the claims hereinafter appended.

We claim:

1. A method for improving the whitened appearance of laundered cellulosic fabrics, using at least two brightening steps, the method comprising:

(a) a first brightening step comprising contacting a fabric item comprising a soiled cellulosic fabric with a liquid detergent composition comprising an anionic sulfate or alkoxylated nonionic surfactant composition, a solvent, and about 0.001 to 1 wt % of an optical brightener in an aqueous medium at a pH between about 6.5 and 10.5 to produce a treated item;

(b) an extraction step comprising substantially removing residual liquid detergent composition from the treated item;

(c) a second brightening step comprising contacting the extracted item with an aqueous laundry composition comprising a surfactant package comprising a conventional laundry detergent and about 0.001 to 1 wt % of an optical brightener, such brightener being a styryl composition, to form a cleaned fabric item; and (d) cleaning a food contact surface with the cleaned fabric item;

wherein the cellulosic fabric has substantially improved bright white appearance when compared to fabric laundered with a single brightening laundry step.

2. The method of claim 1 wherein the fabric item comprises a white cotton towel.

3. The method of claim 2 wherein the fabric item comprises a white cotton terry cloth towel.

4. The method of claim 1 wherein the liquid detergent composition comprises about 0.005 to about 0.5 wt % of an optical fluorescent brightening agent.

5. The method of claim 1 wherein the liquid detergent composition comprises a major proportion of water, about 1 to 10 parts by weight of a source of alkalinity, about 1 to 50 parts by weight of a surfactant blend of a nonionic and an anionic surfactant, about 1 to 8 wt % of a solvent comprising a lower mono- or dihydroxy compound and about 0.01 to about 0.3 wt % of a fluorescent optical brightener.

6. The method of claim 5 wherein the surfactant blend comprises about 1 to 15 parts by weight of a nonionic and about 1 to 15 parts by weight of an anionic surfactant.

7. The method of claim 1 wherein the fabric item is used damp.

8. A method of cleaning a food contact surface with a cellulosic towel, the method comprising:

(a) contacting the food contact surface with a dampened cellulosic towel to remove soils, producing a soiled towel;

(b) introducing the soiled towel into a brightened liquid detergent composition comprising a surfactant composition, a solvent and about 0.001 to about 1 wt % of an optical brightener, such brightener being a styryl composition in an aqueous medium having a pH between about 6.5 to 10.5 to produce a treated towel;

(c) extracting the treated towel to remove the aqueous composition;

(d) contacting the extracted item with an aqueous laundry composition comprising a surfactant package comprising a conventional laundry detergent and about 0.01 to 1 wt % of an optical brightener to produce a clean brightened cellulosic towel; and (e) reusing the cellulosic towel in a moist condition.

9. The method of claim 8 wherein the cellulosic towel comprises a terry cloth cotton towel.

10. The method of claim 8 wherein the soil comprises fast food soils.

* * * * *